US009812778B2

(12) United States Patent
Camilleri et al.

(10) Patent No.: US 9,812,778 B2
(45) Date of Patent: Nov. 7, 2017

(54) INTEGRATED CIRCUIT APPARATUS WITH SWITCHED ANTENNAS

(71) Applicant: Nitero Pty Ltd., Fitzroy, Victoria (AU)

(72) Inventors: Natalino Camilleri, Cupertino, CA (US); Stevan Preradovic, Melbourne (AU)

(73) Assignee: ADVANCED MICRO DEVICES, INC., Sunnyvale, CA (US)

( * ) Notice: Subject to any disclaimer, the term of this patent is extended or adjusted under 35 U.S.C. 154(b) by 0 days.

(21) Appl. No.: 14/484,630

(22) Filed: Sep. 12, 2014

(65) Prior Publication Data

US 2016/0079666 A1 Mar. 17, 2016

(51) Int. Cl.
*H01Q 3/24* (2006.01)
*H01Q 21/00* (2006.01)

(52) U.S. Cl.
CPC ..... *H01Q 3/24* (2013.01); *H01Q 21/0006* (2013.01)

(58) Field of Classification Search
CPC .... H01Q 3/24; H01Q 3/2682; H01Q 21/0006; H01Q 3/26–3/42
USPC ..... 342/374, 375, 366–377
See application file for complete search history.

(56) References Cited

U.S. PATENT DOCUMENTS

| | | | | |
|---|---|---|---|---|
| 5,943,011 | A * | 8/1999 | Acoraci et al. | 342/373 |
| 6,438,389 | B1 * | 8/2002 | Sandhu | H01Q 3/24 370/332 |
| 6,907,272 | B2 * | 6/2005 | Roy | 455/562.1 |
| 2004/0027304 | A1 * | 2/2004 | Chiang et al. | 343/810 |
| 2015/0372387 | A1 * | 12/2015 | Porter | H01Q 3/24 343/777 |

FOREIGN PATENT DOCUMENTS

| | | | | |
|---|---|---|---|---|
| DE | 10004000 | A1 * | 8/2001 | H04W 16/28 |

* cited by examiner

*Primary Examiner* — Cassie Galt
(74) *Attorney, Agent, or Firm* — Hickman Palermo Becker Bingham LLP; Edward A. Becker

(57) ABSTRACT

An apparatus that includes three or more antennas and an integrated circuit selects antennas for use, i.e., for transmission and reception of electromagnetic radiation. The apparatus selects, at a first time, from the three or more antennas, two antennas having approximately the same feed line length so that the two antennas operate at the same phase and at a first angle. The apparatus selects, at a second time that is different than the first time, from the three or more antennas, two antennas having different feed line lengths so that the two antennas selected for use at the second time operate at different phases and at a second angle that is different than the first angle. In this manner the apparatus may change the pattern and/or shape of electromagnetic radiation transmitted by the apparatus by selecting for use particular antennas having different feed line lengths.

13 Claims, 5 Drawing Sheets

200

| Configuration | A1 | A2 | A3 | A4 | Radiation Angle |
|---|---|---|---|---|---|
| C1 | OFF | ON | ON | OFF | 0 Degrees |
| C2 | ON | OFF | OFF | ON | 0 Degrees |
| C3 | ON | ON | OFF | OFF | -30 Degrees |
| C4 | OFF | OFF | ON | ON | +30 Degrees |

600

| Configuration | A1 | A2 | A3 | A4 | A5 | A6 | A7 | A8 | Radiation Angle |
|---|---|---|---|---|---|---|---|---|---|
| C1 | OFF | OFF | OFF | ON | ON | OFF | OFF | OFF | 0 Degrees |
| C2 | ON | OFF | OFF | OFF | OFF | OFF | OFF | ON | 0 Degrees |
| C3 | OFF | OFF | ON | ON | OFF | OFF | OFF | OFF | -30 Degrees |
| C4 | OFF | ON | OFF | ON | OFF | OFF | OFF | OFF | -45 Degrees |
| C5 | ON | OFF | OFF | ON | OFF | OFF | OFF | OFF | -60 Degrees |
| C6 | OFF | OFF | OFF | OFF | ON | ON | OFF | OFF | +30 Degrees |
| C7 | OFF | OFF | OFF | OFF | ON | OFF | ON | OFF | +45 Degrees |
| C8 | OFF | OFF | OFF | OFF | ON | OFF | OFF | ON | +60 Degrees |

INTEGRATED CIRCUIT APPARATUS WITH SWITCHED ANTENNAS

FIELD OF THE INVENTION

The present invention relates to devices that operate in the 60 GHz frequency band, and more specifically, to an integrated circuit package with switched antennas to provide a phase differential.

BACKGROUND

The availability of millimeter wave (mm-wave) frequency bands has contributed to the expanding of main stream applications of mm-wave wireless technologies. The 60 GHz band has been made available and various applications such as Wireless HD and WiFi standard 802.11ad. Also, the progress in developing mm-wave radio frequency integrated circuits (RFICs) is providing the path to mobile and personal computing applications. Packaging for mm-wave RFICs usually comprises the antennas used for communication between 2 mm-wave transceivers. Developing antennas which exhibit omni-directional radiation capability is a challenge especially when the antennas are placed within the packaging where size, cost and material are limiting factors. So far using antenna arrays where the antenna radiation pattern/beam is steered in different directions has been a way of extending the direction and angles of radiation of the antenna arrays. This method however, requires that the RFIC have phase shifting capabilities of the signal fed to each antenna array element in order to control the radiation pattern shape, which increases the size, complexity and cost of RFICs.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

BRIEF DESCRIPTION OF THE DRAWINGS

Embodiments are depicted by way of example, and not by way of limitation, in the figures of the accompanying drawings and in which like reference numerals refer to similar elements and in which.

DETAILED DESCRIPTION

In the following description, for the purposes of explanation, numerous specific details are set forth in order to provide a thorough understanding of the present invention.

It will be apparent, however, that the present invention may be practiced without these specific details. In other instances, well-known structures and devices are shown in block diagram form in order to avoid unnecessarily obscuring the present invention.

I. Overview

An apparatus includes the capability to change a pattern and/or shape of electromagnetic radiation emitted by the apparatus. The apparatus includes three or more antennas and an integrated circuit. The three or more antennas include at least two antennas with different feed line lengths. The apparatus selects antennas for use, i.e., for transmission and reception of electromagnetic radiation. The apparatus selects, at a first time, from the three or more antennas, two antennas having approximately the same feed line length so that the two antennas operate at the same phase and at a first angle. The apparatus selects, at a second time that is different than the first time, from the three or more antennas, two antennas having different feed line lengths so that the two antennas selected for use at the second time operate at different phases and at a second angle that is different than the first angle. In this manner the apparatus may change the pattern and/or shape of electromagnetic radiation transmitted by the apparatus by selecting for use particular antennas having different feed line lengths and de-selecting for use other antennas. The approach provides a low cost beam steering solution with favorable gain characteristics that eliminates the need for the apparatus to use phase shifting components to change the phase of signals fed to antennas in the apparatus.

II. Switched Antenna Architecture

Figures 1, 2:
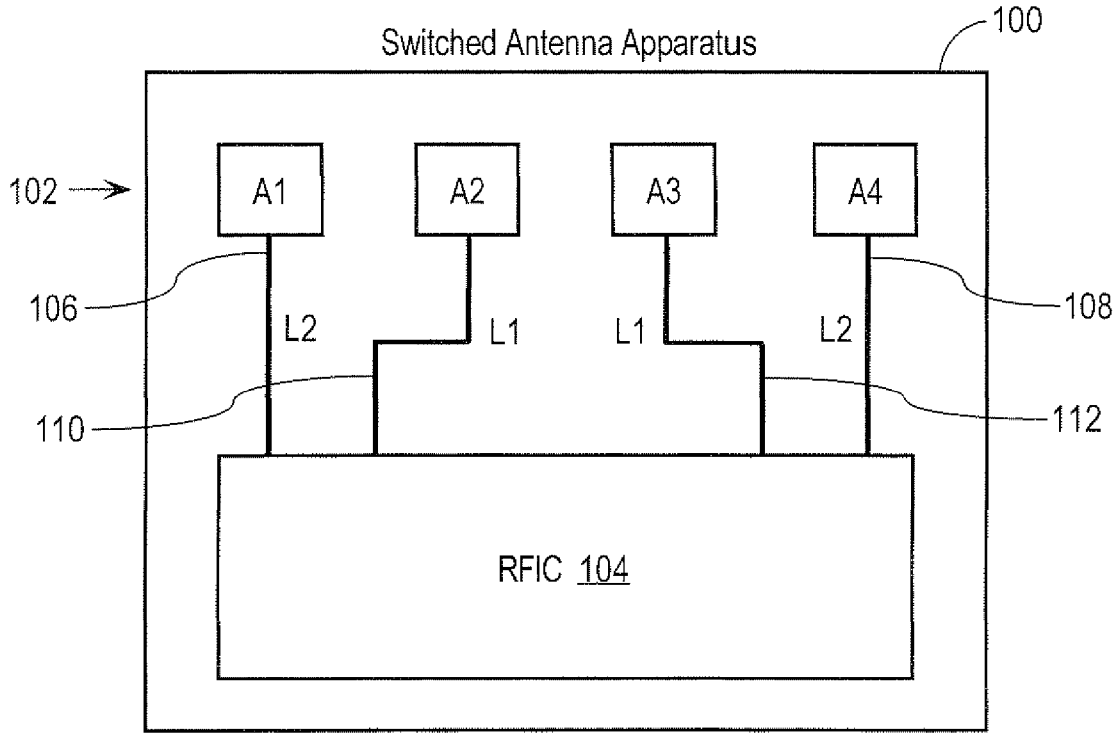
FIG. 1 is a diagram that depicts an example switched antenna apparatus 100.
FIG. 2 is a table that depicts four example antenna selection configurations.

FIG. 1 is a diagram that depicts an example switched antenna apparatus 100 according to an embodiment. In this example, switched antenna apparatus 100 includes antennas 102, identified individually as "A1", "A2", "A3" and "A4" and a Radio Frequency Integrated Circuit (RFIC) 104. Switched antenna apparatus 100 may include other components and elements, depending upon a particular implementation, and switched antenna apparatus 100 is not limited to any particular components or elements. Example implementations for switched antenna apparatus 100 include, without limitation, a receiver, a transmitter, a transceiver, or an integrated circuit package. Thus, antennas 102 may be located within an RFIC package that includes RFIC 104, or antennas 102 may be external to an RFIC package that includes RFIC 104.

Antennas 102 may be any type of antenna that may vary depending upon a particular implementation and antennas 102 may all be the same type or include different types. Example implementations of antennas 102 include, without limitation, patch antennas, dipole antennas, end-firing antennas, Yagi antennas, etc., or any combination thereof. Antennas 102 are connected to RFIC 104 via feed lines 106, 108, 110, 112.

Each feed line 106, 108, 110, 112 has a specified feed line length. As used herein, the term "feed line length" refers to a length of a feed line from an antenna to RFIC 104. A feed line length may be determined by the physical characteristics of the connection between an antenna and RFIC 104, such as dimensional length of the connection and materials used to fabricate the connection. For example, a first antenna may have a feed line length of 3 mm and a second antenna may have a feed line length of 4 mm. The feed line length may also be affected by surrounding structures and materials. For example, an effective feed line length may be changed by exposing portions of an antenna feed line to a ground plane, e.g., via cutouts or "windows" in an underlying insulating material.

According to one embodiment, one or more of feed lines 106, 108, 110, 112 have different feed line lengths. In the example depicted in FIG. 1, antennas A2 and A3 have a feed line length of L1 and antennas A1 and A4 have a feed line length of L2, where L2 is different than L1. The values for L1 and L2 may be selected to achieve a specified phase shift and corresponding angular steering when operating at a particular frequency, or frequency band. As one non-limiting example, in the 60 GHz frequency band, a difference in length between L1 and L2 of 0.65 mm may provide a phase shift of 90 degrees and a corresponding angular steering of 30 degrees. The values for L1 and L2 may also vary depending upon a particular implementation, for example, whether antennas 102 and RFIC 104 are co-located in an integrated circuit package, or whether antennas 102 are located outside of an integrated circuit package, e.g., on a printed circuit board. The different feed line lengths L1, L2 may be achieved, for example, by routing feed lines 106, 108, 110, 112 in a particular manner within an integrated circuit package or on a printed circuit board.

III. Antenna Switching

According to one embodiment, antennas 102 are selected for use and/or de-selected for use to achieve a desired radiation pattern and/or shape. As used herein, the term "selected for use" refers to selecting an antenna to be used for transmission and/or reception of electromagnetic radiation and the term "de-selected for use" refers to selecting an antenna to not be used for transmission and/or reception of electromagnetic radiation.

Antenna selection may be accomplished using a wide variety of techniques that may vary depending upon a particular architecture and implementation. RFIC 104 may be configured to select an antenna for transmission by controlling one or more power amplifiers or select an antenna for receiving by controlling one or more LNAs. For example, RFIC 104 may turn the biasing (power supply) on or off for a power amplifier or LNA that corresponds to a particular antenna. As another example, RFIC 104 may change the status of a switch circuit (ON/OFF) that is between the power amplifier or the LNA and the particular antenna to control whether the output of the power amplifier or the input of the LNA is connected to the particular antenna or not, without manipulating the biasing of the power amplifier or LNA. RFIC 104 may be configured with hardware and/or software interfaces, e.g., application program interfaces (APIs), to allow other components and software processes, either within or external to switched antenna apparatus 100, to issue commands to RFIC 104 to select and de-select antennas for use. For example, participant devices in communication with the switched antenna apparatus 100 may issue commands to RFIC 104 to select and de-select antennas for use.

Figure 3A:
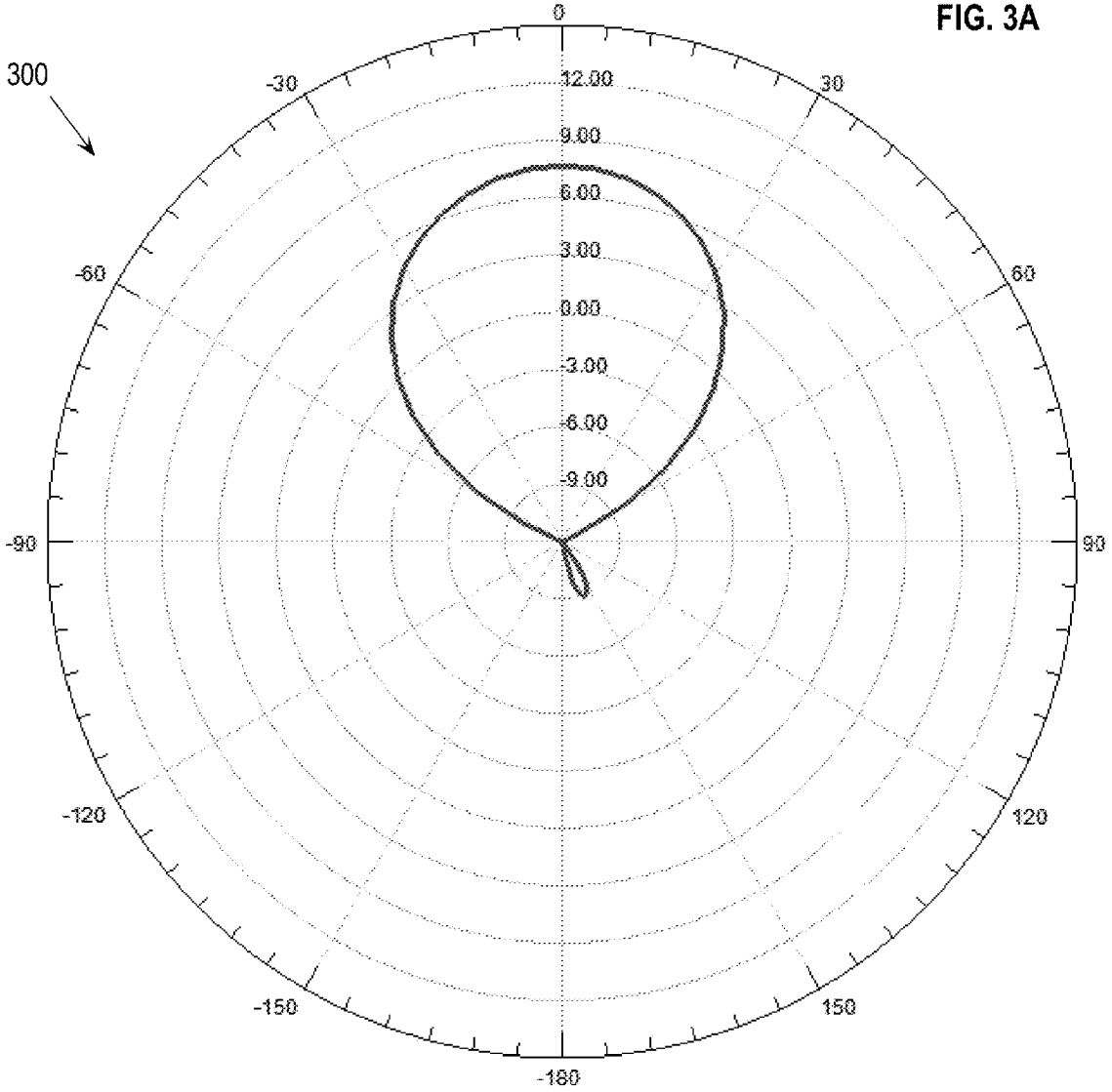
FIG. 3A depicts an example radiation pattern for a first antenna configuration.

FIG. 2 is a table 200 that depicts four example antenna selection configurations identified as "C1", "C2", "C3" and "C4". The notation "ON" means that the antenna has been selected for use and the notation "OFF" means that the antenna has been de-selected for use. In the first antenna selection configuration C1 in the second row of table 200, antennas A2 and A3 are selected for use and antennas A1 and A4 are de-selected for use. FIG. 3A depicts an example radiation pattern 300 for the first antenna configuration C1, which reflects that the two antennas selected for use, i.e., antennas A2 and A3 have at least approximately the same feed line length and operate in phase. More specifically, the radiation pattern 300 is centered about zero degrees, with no steering. A similar radiation pattern may be realized with the second antennal selection configuration C2, in which antennas A1 and A4 are selected for use (and antennas A2 and A3 are de-selected for use), since antennas A1 and A4 have at least approximately the same feed line length and also operate in phase.

Figure 3B:
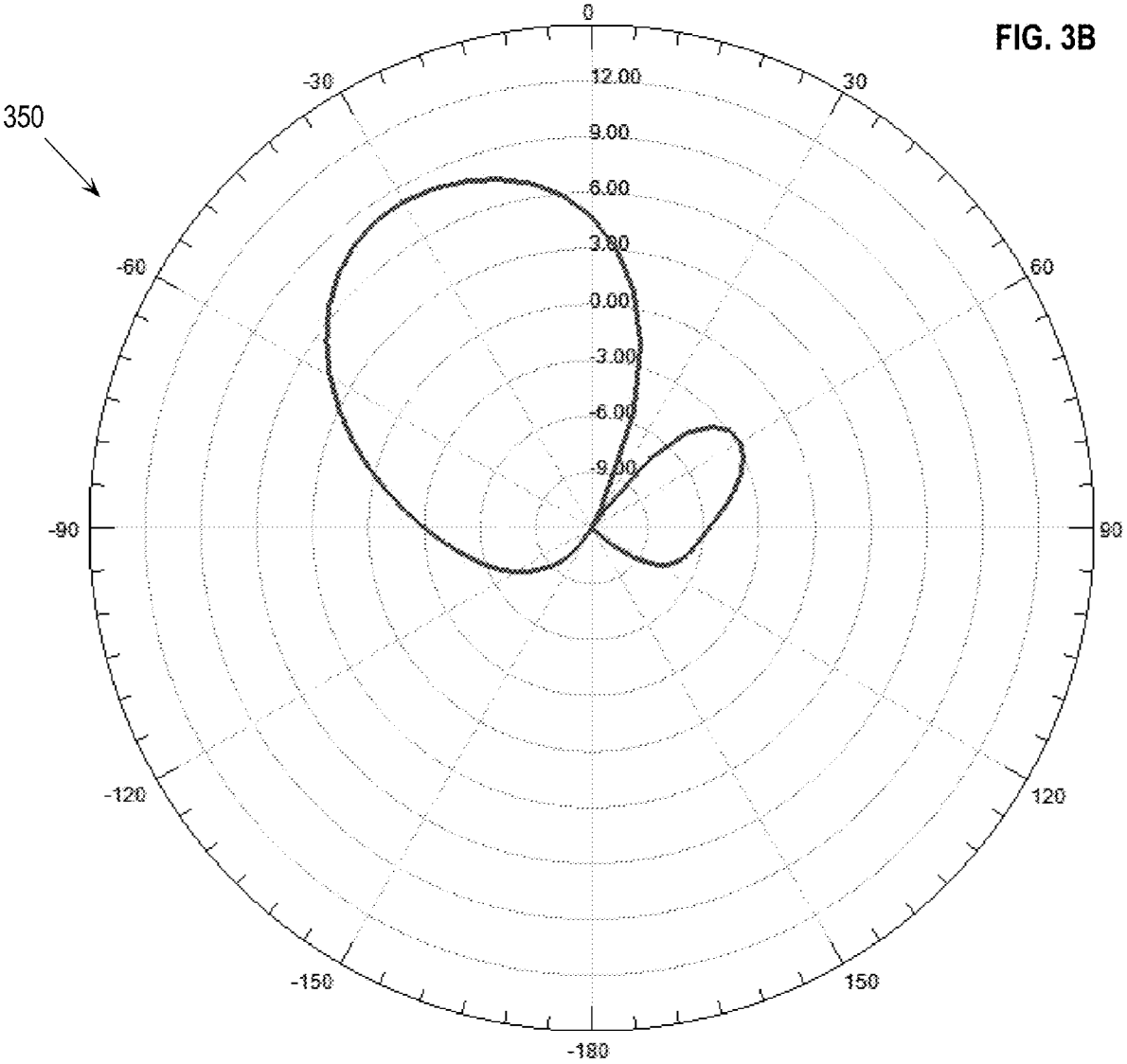
FIG. 3B depicts an example radiation pattern for a third antenna configuration.

With the third antennal selection configuration C3, antennas A1 and A2 are selected for use and antennas A3 and A4 are de-selected for use. Antennas A1 and A2 have different feed line lengths and operate out of phase, which changes the radiation pattern and/or shape. FIG. 3B depicts an example radiation pattern 350 for the third antenna configuration C3, which reflects that the two antennas selected for use, i.e., antennas A1 and A2 have different feed line lengths and operate out of phase. In this example, the radiation pattern is centered around −30 degrees and also has a different shape than the radiation pattern 300 depicted in FIG. 3A. A similar radiation pattern may be realized with the fourth antennal selection configuration C4, in which antennas A3 and A4 are selected for use (and antennas A1 and A2 de-selected for use), since antennas A3 and A4 have different feed line lengths and also operate out of phase. In this example, the radiation pattern may be centered around +30 degrees and may also have a different shape than the radiation pattern 300 depicted in FIG. 3A. Given that both antennas A2 and A3 have a feed line length of L1 and both antennas A1 and A4 have a feed line length of L2, changing the antenna selection configuration from C1 or C2 to C3 or C4 changes the radiation angle by approximately the same amount, i.e., 30 degrees. For example, suppose that the switched antenna apparatus 100 is operating using antenna selection configuration C1 and radiating at 0 degrees. Changing to antenna selection configuration C3 changes the radiation angle from 0 degrees to −30 degrees. Similarly, changing from antenna selection configuration C1 to C4 changes the radiation angle from 0 degrees to +30 degrees. Changing the antenna selection configuration from C3 to C4 changes the radiation angle from −30 degrees to +30 degrees, or by 60 degrees. In other embodiments, antennas may have different feed line lengths to provide different amounts of phase shift and corresponding changes in radiation angles. For example, antennas C2 and C3 may have a feed line length of L1, as depicted in FIG. 1, but antennas A1 and A4 may have different feed line lengths, that are also different than the feed line length L1 of antennas C2 and C3. This allows the switched antennas apparatus 100 to operate at a first angle when antennas A2 and A3 are selected for use, at a second angle when antennas A2 and A1 are selected for use, and at a third angle when antennas A3 and A4 are selected for use. For example, the first angle might be 0 degrees, the second angle −30 degrees and the third angle +15 degrees.

Figure 4:
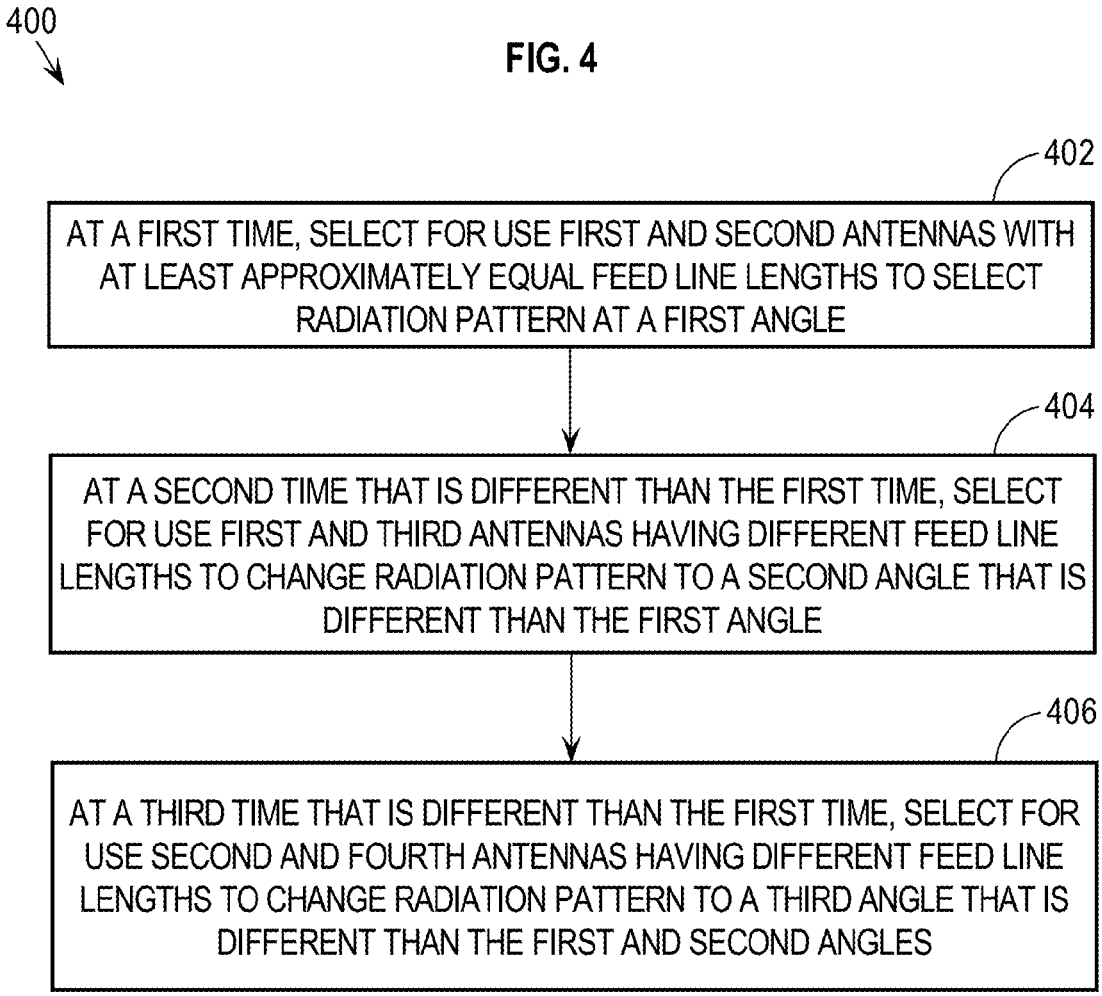
FIG. 4 is a flow diagram that depicts an approach for a switched antenna apparatus to use different antenna selection configurations.

FIG. 4 is a flow diagram 400 that depicts an approach for a switched antenna apparatus to use different antenna selection configurations according to an embodiment. In step 402, at a first time, first and second antennas are selected for use. For example, RFIC 104 may select antennas A2 and A3 for use and optionally de-select antennas A1 and A4 for use, depending upon whether antennas A1 and A4 were previously selected for use. The first and second antennas have approximately equal feed line lengths and the radiation pattern radiates at a first angle. For example, the first and second antennas may radiate about zero degrees, with no steering, as depicted in FIG. 3A.

In step 404, at a second time that is different than the first time, first and third antennas are selected for use. For example, RFIC 104 may select antennas A2 and A1 for use and de-select antennas A3 and A4 for use. Since antenna A2 was previously selected for use, a command does not necessarily need to be issued to select antenna A2 for use. Similarly, since antenna A4 was previously de-selected for use, a command does not necessarily need to be issued to de-select antenna A4 for use. Whether these optional commands are issued may depend upon a particular implementation. For example, in some implementations, a command may be issued to select a particular antenna for use, regardless of whether the particular antenna is already selected for use. The first and third antennas have different feed line lengths, which changes the angle of the radiation pattern from the first angle to a second angle that is different than the first angle. For example, the first and third antennas may radiate at −30 degrees, as depicted in FIG. 3B.

In step 406, at a third time that is different than the first time and the second time, second and fourth antennas are selected for use. For example, RFIC 104 may select antennas A3 and A4 for use and de-select antennas A1 and A2 for use. The second and fourth antennas have different feed line lengths, which changes the angle of the radiation pattern to a third angle that is different than the first angle and the second angle. For example, the first and third antennas may radiate at +30 degrees. Not all of these steps are required and additional steps may be performed, depending upon a particular implementation. As one example, step 406 may be optional.

Antenna switching as described herein may be employed at any phase in communication, for example, during initialization of a communications system, or during active communications sessions. In addition, after an initial antenna configuration has been selected, a different antenna configuration may be selected at any time, for example, to accommodate a change in position of communication participants. For example, at a first time, a first antenna configuration may be selected for communications between a first participant and a second participant and at a second time that is different than the first time, a second antenna configuration may be selected for communications between the first participant and the second participant. Antenna configurations may be selected based upon the particular participants participating in communications. For example, a first antenna configuration may be selected for communications between a first participant and a second participant and a second antenna configuration may be selected for communications between the first participant and a third participant, where the second and third participants are different participants. Antenna configurations may be selected based upon whether a device is transmitting or receiving signals. For example, a first pair of antennas may be selected for transmission and a different pair of antennas selected for reception.

Figures 5, 6:
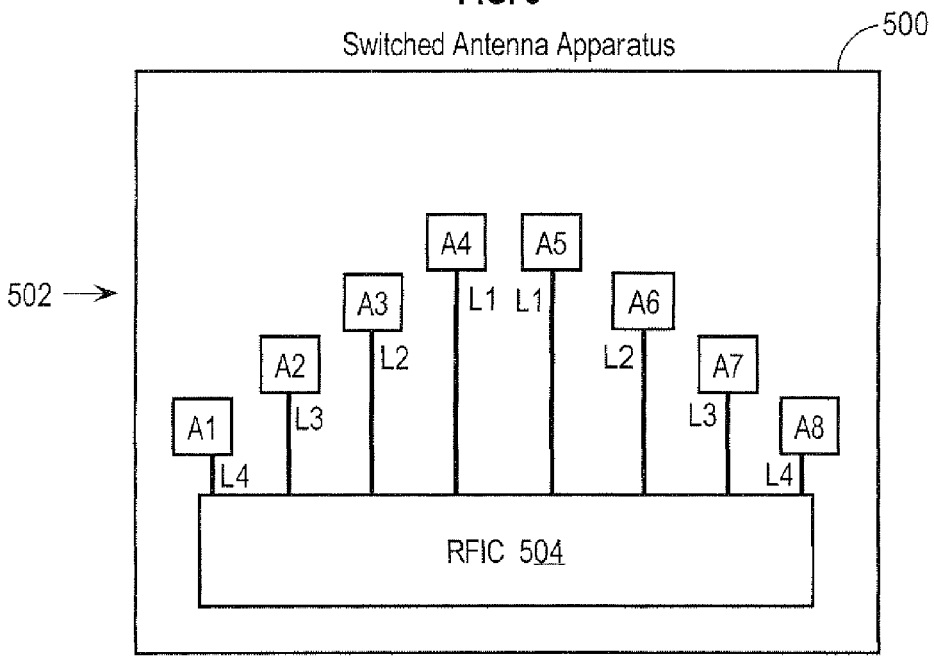
FIG. 5 depicts an example switched antenna arrangement that includes eight antennas.
FIG. 6 is a table that depicts eight example antenna selection configurations.

Embodiments are described herein in the context of four antennas for purposes of explanation only and embodiments are applicable to switched antenna arrangements using any number of antennas. Antenna arrangements with a greater number of antennas and different feed line lengths may be used to increase the granularity of steering. For example, FIG. 5 depicts an example switched antenna arrangement 500 that includes eight antennas 502, identified as A1-A8. Antennas A4 and AS have a feed line length of L1, antennas A3 and A6 have a feed line length of L2, antennas A2 and A7 have a feed line length of L3 and antennas A1 and A8 have a feed line length of L4. FIG. 6 is a table 600 that depicts eight example antenna selection configurations that may be used with switched antenna arrangement 500 of FIG. 5. In this example, the switched antenna arrangement 500 may be operated at angles of 0, −30, −45, −60, +30, +45 and +60 degrees by selecting antennas with particular feed line lengths. Although embodiments are described herein in the context of selecting for use pairs of antennas, embodiments are not limited to these examples and any number of antennas may be selected for use, depending upon a particular implementation.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. An apparatus comprising:

a transceiver;

three or more antennas configured to transmit and receive signals, the three or more antennas including a first antenna having a first feed line length, a second antenna having a second feed line length, and a third antenna having a third feed line length, wherein the third feed line length is different than the second feed line length; and an integrated circuit configured to:

at a first time, select for transmission and reception of electromagnetic radiation, from the three or more antennas, the first antenna and the second antenna, wherein the first feed line length and the second feed line length are selected so that the first antenna and the second antenna operate together to achieve a first predetermined phase and angle when operating in a specified frequency band, and at a second time that is different than the first time, and in response to a change in position of one or more participants participating in communications with the apparatus, select for transmission and reception of electromagnetic radiation from the three or more antennas, the first antenna and the third antenna, wherein the first feed line length and the third feed line length are selected so that the first antenna and the third antenna operate together to achieve a second predetermined phase and angle when operating in the specified frequency band, wherein the second predetermined phase and angle are different than the first predetermined phase and angle.

2. The apparatus as recited in claim 1, wherein:

the three or more antennas include a fourth antenna having a fourth feed line length that is different than both the second feed line length and the third feed line length, and the integrated circuit is further configured to at a third time that is different than the first time and the second time, select for transmission and reception of electromagnetic radiation, from the three or more antennas, the first antenna and the fourth antenna, wherein the first feed line length and the fourth feed line length are selected so that the second antenna and the fourth antenna operate together at a third predetermined phase and angle when operating in the specified frequency band, wherein the third predetermined phase and angle are different than the first predetermined phase and angle and the second predetermined phase and angle.

3. The apparatus as recited in claim 1, wherein the first feed line length is approximately equal to the second feed line length.

4. The apparatus as recited in claim 1, wherein the integrated circuit is further configured to, at the first time, de-select for transmission and reception of electromagnetic radiation the third antenna from the three or more antennas.

5. The apparatus as recited in claim 1, wherein:

the three or more antennas include a fourth antenna having a fourth feed line length and a fifth antenna having a fifth feed line length, wherein the fourth feed line length is approximately equal to the fifth feed line length, and wherein the fourth feed line length and the fifth feed line length are different than the second feed line length and the third feed line length, and the integrated circuit is further configured to at a third time that is different than the first time and the second time, select for transmission and reception of electromagnetic radiation, from the three or more antennas, the fourth antenna and the fifth antenna, wherein the fourth feed line length and the fifth lead line length are selected so that the fourth antenna and the fifth antenna operate together to achieve a third predetermined phase and angle when operating in the specified frequency band, wherein the third predetermined phase and angle are different than the first predetermined phase and angle and the second predetermined phase and angle.

6. The apparatus as recited in claim 1, wherein the integrated circuit is configured to select for transmission and reception of electromagnetic radiation, from the three or more antennas, the first antenna having the first feed line length and the second antenna having the second feed line length in response to a command received by the integrated circuit.

7. The apparatus as recited in claim 1, wherein the three or more antennas are antennas of the same type.

8. The apparatus as recited in claim 1, wherein the first feed line length is a first dimensional length, the second feed line length is a second dimensional length, and the third feed line length is a third dimensional length.

9. The apparatus as recited in claim 1, wherein:

the first feed line length is a first effective feed line length, the second feed line length is a second effective feed line length, and the third feed line length is a third effective feed line length, and the third effective feed line length is different than the second effective feed line length based upon at least an exposure to a ground plane of one or more portions of a feed line for the third antenna.

10. The apparatus as recited in claim 1, wherein the apparatus is an integrated circuit package.

11. The apparatus as recited in claim 1, wherein the selection, at the second time, of the first antenna and the third antenna is performed in response to a change in participants participating in communications with the apparatus.

12. The apparatus as recited in claim 1, wherein the specified frequency band is the 60 GHz frequency band.

13. The apparatus as recited in claim 1, wherein the specified frequency band is a millimeter wave frequency band.

* * * * *